US007456854B2

(12) United States Patent
Naito et al.

(10) Patent No.: US 7,456,854 B2
(45) Date of Patent: Nov. 25, 2008

(54) THERMAL PRINTER

(75) Inventors: Tadahiro Naito, Kadoma (JP); Yutaka Noda, Yokoyama (JP)

(73) Assignee: Funai Electric Co., Ltd., Osaka (JP)

( * ) Notice: Subject to any disclaimer, the term of this patent is extended or adjusted under 35 U.S.C. 154(b) by 403 days.

(21) Appl. No.: 11/327,428

(22) Filed: Jan. 9, 2006

(65) Prior Publication Data

US 2006/0158506 A1 Jul. 20, 2006

(30) Foreign Application Priority Data

Jan. 14, 2005 (JP) ..... 2005-007439

(51) Int. Cl.
*B41J 2/38* (2006.01)

(52) U.S. Cl. ..... 347/186

(58) Field of Classification Search ..... 347/185, 347/186, 197, 222; 400/120.08, 120.16
See application file for complete search history.

(56) References Cited

U.S. PATENT DOCUMENTS

2005/0280691 A1* 12/2005 Kawamoto ..... 347/194

FOREIGN PATENT DOCUMENTS

JP 02-217269 A 8/1990
JP 06-8502 A 1/1994
JP 08-169133 A 7/1996
JP 08-290603 11/1996
JP 09-109432 A 4/1997
JP 09-254426 9/1997
JP 11-58808 A 3/1999

OTHER PUBLICATIONS

Computer-generated translation of JP 09-109432 cited in the IDS filed on Jan. 9, 2006.*

* cited by examiner

*Primary Examiner*—Huan H Tran
(74) *Attorney, Agent, or Firm*—Global IP Counselors, LLP

(57) ABSTRACT

A thermal printer includes a control part; a thermal head that is heated upon a heating instruction from the control part and stops heating upon a heating-ending instruction from the control part; a temperature detector that detects a temperature of the thermal head upon a temperature detection instruction from the control part; and a feed motor that is driven upon a conveyance instruction from the control part and stops the conveyance upon a conveyance-ending instruction from the control part. The control part issues, prior to printing, the heating instruction and the conveyance instruction such that the heating of the thermal head and the conveyance of the paper are performed in parallel. The control part issues the temperature detection instruction as an interrupt every predetermined period of time after the heating instruction is issued, and issues the heating-ending instruction when the temperature of the thermal head reaches a predetermined preheat-ending temperature.

7 Claims, 6 Drawing Sheets

THERMAL PRINTER

BACKGROUND OF THE INVENTION

1. Field of the Invention

The present invention relates to a thermal printer having a thermal head.

2. Background Information

A thermal printer that performs printing with a thermal head is well known. In such thermal printer, prior to the start of the printing operation, it is necessary to preheat the thermal head. Furthermore, it is necessary to convey the paper to the printing position prior to the start of the printing operation. In known technologies, these preheating operation and paper conveyance operation are performed serially. For example, as shown in FIG. 7, a mechanical preparatory operation such as the conveyance of the paper is performed first, at the end of which the preheating operation is performed.

In the case shown in FIG. 7, since the preheating operation and the mechanical preparatory operation are performed serially, it takes a long time before the thermal printer is ready for the actual printing operation. Furthermore, where the preheating operation is performed before the mechanical preparatory operation, since the preheating operation and the mechanical preparatory operation are performed serially, the temperature of the thermal head is not checked until the mechanical preparatory operation is at least half way complete. This tends to result in overheating of the thermal head, which undesirably shortens the useful life of the thermal head.

In view of the above, it will be apparent to those skilled in the art from this disclosure that there exists a need for an improved thermal printer that overcomes the above described problems. This invention addresses this need in the art as well as other needs, which will become apparent to those skilled in the art from this disclosure.

SUMMARY OF THE INVENTION

It is an object of the present invention to provide a thermal printer which enables a shorter processing time prior to printing while allowing to prolong the useful life of the thermal head.

The first aspect of the present invention provides a thermal printer adapted to perform printing on a paper. The thermal printer includes a casing; a control part; a thermal head pivotably supported to the casing and operatively connected to the control part such that the thermal head is heated upon a heating instruction from the control part and the heating is ended upon a heating-ending instruction from the control part; a temperature detector operatively connected to the control part such that the temperature detector detects a temperature of the thermal head upon a temperature detection instruction from the control part; and a feed motor adapted to convey the paper, the feed motor being operatively connected to the control part such that the feed motor is driven upon a conveyance instruction from the control part and that the conveyance is ended upon a conveyance-ending instruction from the control part. The control part is configured to issue, prior to printing, the heating instruction and the conveyance instruction such that the heating of the thermal head and the conveyance of the paper are performed in parallel. The control part is configured to issue the temperature detection instruction as an interrupt every predetermined period of time after the heating instruction is issued. The control part is configured to issue the heating-ending instruction when the temperature of the thermal head detected by the temperature detector reaches a predetermined preheat-ending temperature.

In this construction, the mechanical preparatory operation is initiated following the initiation of the preheating of the thermal head, and the temperature detector monitors the head temperature, thereby monitoring the timing at which the preheating is to be ended, during the execution of the mechanical preparatory operation. In other words, the preheating of the thermal head and the mechanical preparatory operation are executed in parallel. As a result, the overall processing time or the waiting time prior to the printing can be shortened as compared to a case in which the preheating of the thermal head and the mechanical preparatory operation are executed serially. Such shortening of the processing time prior to the printing makes the thermal printer easier to use for the user.

Furthermore, by performing the preheating of the thermal head and the mechanical preparatory operation in parallel, the preheating time can be lengthened. Since the preheating is performed while the mechanism preparatory operation is in progress, the preheating can be preformed for a longer period of time while still shortening the overall processing time. Accordingly, as compared to the case in which the preheating is performed quickly after the mechanism preparatory operation in order to shorten the time, the amount of current to be supplied can be reduced, so that the useful life of the thermal head can be extended.

In particular, since the head temperature is detected at each periodic interrupt made by the control part during the execution of the mechanical preparatory operation, finer temperature control can be accomplished. As a result, the preheating end timing can be obtained more precisely. Accordingly, it is possible to reduce the occurrence of excessive accumulation of heat due to the preheating end temperature being exceeded. Thus, the useful life of the thermal head can be prolonged.

In the thermal printer, the control part is preferably configured to issue the temperature detection instruction as an interrupt every 1-2 milliseconds. Accordingly, it is possible to perform finer temperature control as compared to the case in which the head temperature is not detected until one sheet of the image receiving paper is conveyed in the normal direction. As a result, the preheating end timing can be obtained more precisely. Accordingly, occurrence of an excessive accumulation of heat due to the preheating end temperature being exceeded can be reduced, so that the useful life of the thermal head can be prolonged.

The thermal printer preferably further includes a platen roller rotatably supported to the casing; and a mode motor operatively connected to the control part and the thermal head so as to, upon a switching instruction from the control part, switch between a head-up mode in which the thermal head is pivoted away from the platen roller, thereby allowing the conveyance of the paper, and a head-down mode in which the thermal head is pivoted toward the platen roller. The control part is configured to issue the switching instruction and the heating instruction, such that the heating of the thermal head is performed in parallel with the pivoting of the thermal head away from the platen roller.

The head-up operation, the paper feed operation and the head-down operation are mechanical operations that generally take time. In this construction, however, since the mechanical preparatory operation (including these operations) and the preheating of the thermal head are performed in parallel, the overall printing preparation time can be shortened, while the useful life of the thermal head can be lengthened.

In the thermal printer, the control part is preferably and ASIC.

A method of preheating a thermal head of a thermal printer before the thermal printer performs printing on a paper in accordance with another aspect of the present invention includes starting heating of the thermal head; starting conveyance of the paper such that the paper is conveyed while the thermal head is heated; detecting a temperature of the thermal head as an interrupt every predetermined period of time while the thermal head is heated; and ending the heating of the thermal head when the temperature of the thermal head reaches a predetermined preheating-ending temperature.

The method of preheating a thermal head of a thermal printer preferably further includes pivoting the thermal head away from a platen roller before the conveyance of the paper while the thermal head is heated; and pivoting the thermal head toward the platen roller after the conveyance of the paper.

These and other objects, feature, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The thermal printer of the present invention makes it possible to shorten the overall processing time or waiting time prior to printing, and to lengthen the useful life of the thermal head.

Figure 1:
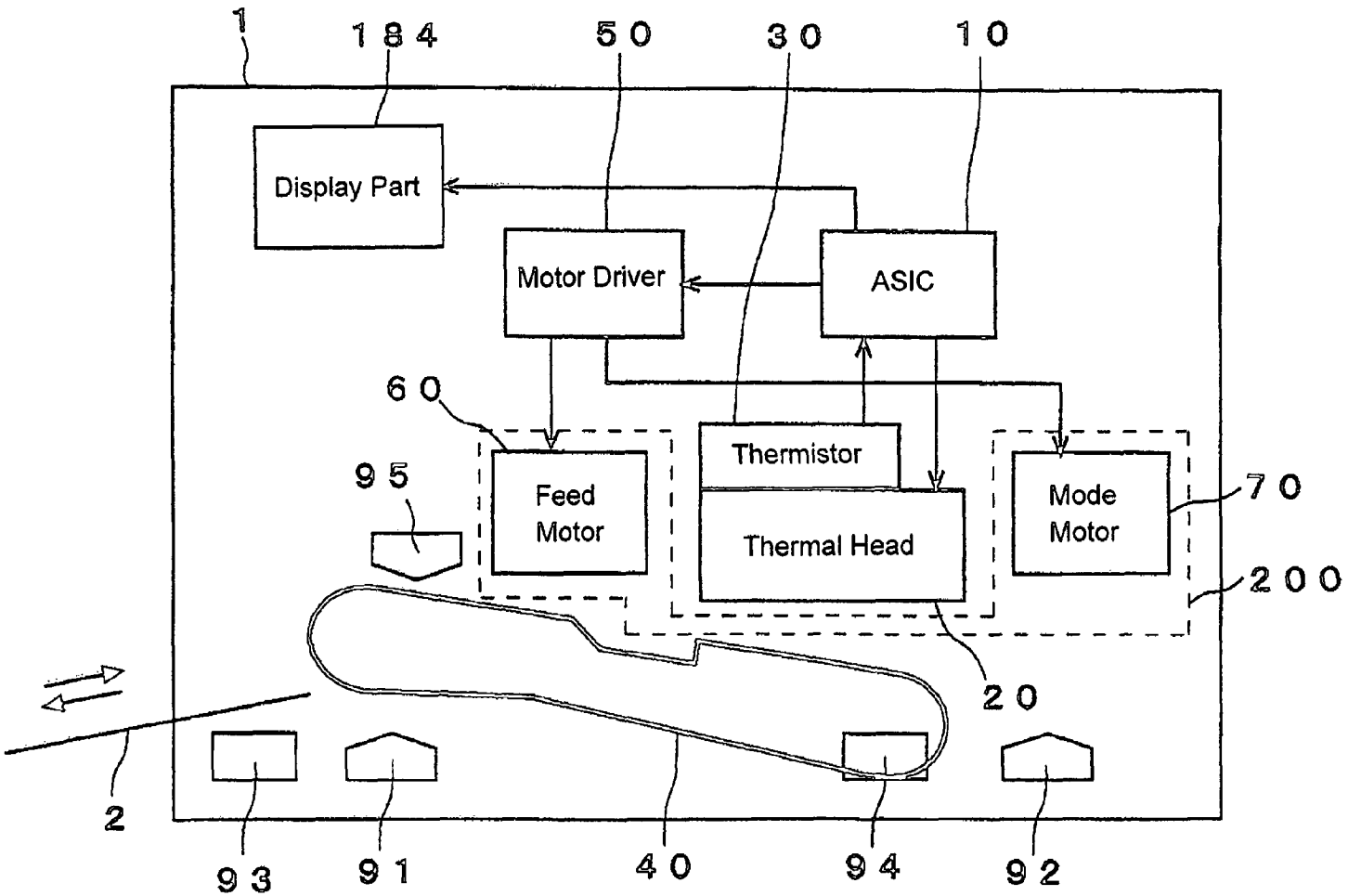
FIG. 1 is a block diagram used to illustrate a thermal printer constituting one embodiment of the present invention.
Figure 2:
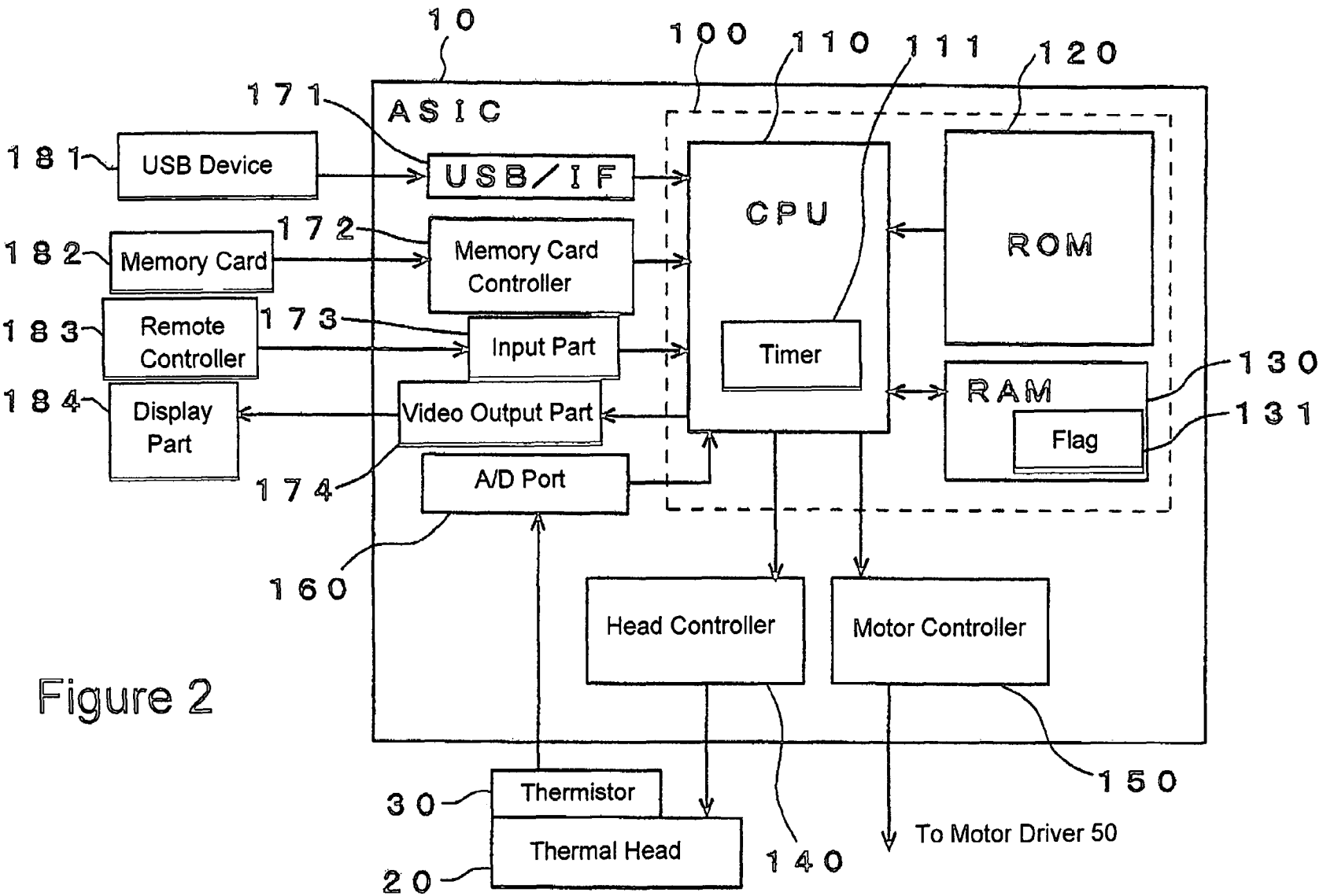
FIG. 2 is a block diagram used to illustrate a thermal printer constituting one embodiment of the present invention.
Figure 3:
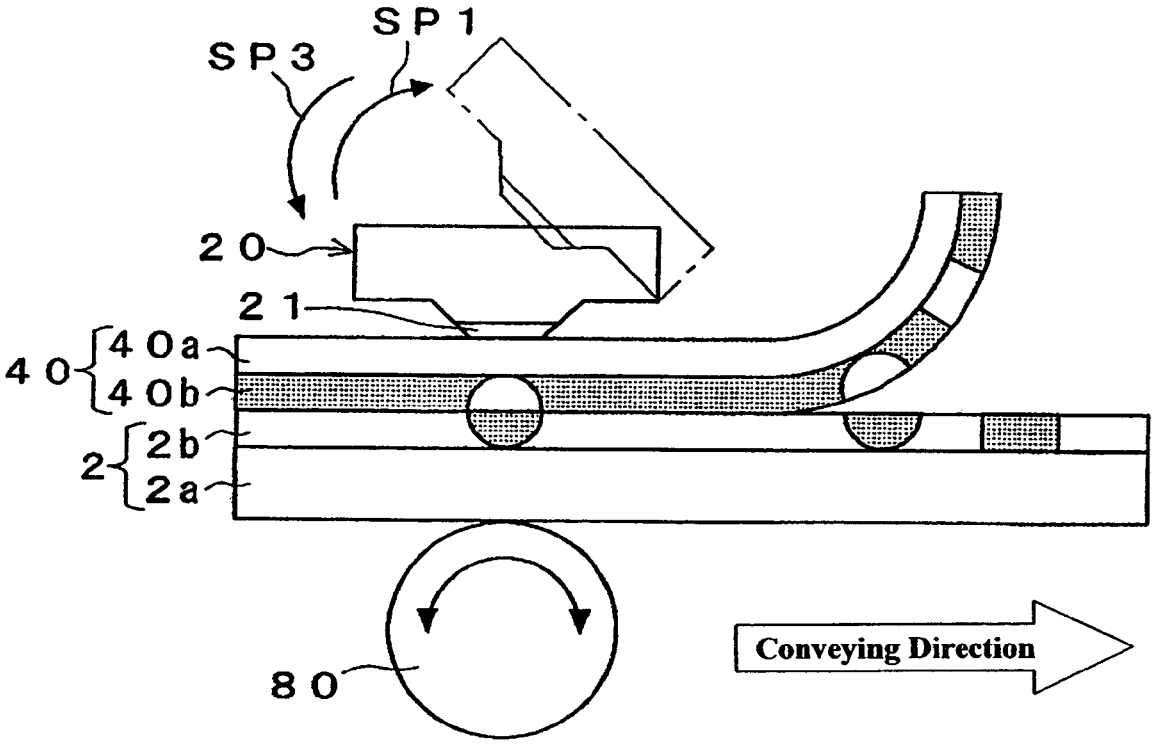
FIG. 3 is a schematic diagram used to illustrate a thermal printer constituting one embodiment of the present invention.

Block diagrams of FIGS. 1 and 2 illustrate a thermal printer in accordance with one embodiment of the present invention. In particular, FIG. 2 illustrates the ASIC (application specific integrated circuit) 10 shown in FIG. 1. FIG. 3 shows a schematic diagram that illustrates the thermal printer 1.

The thermal printer is a so-called sublimation printer. As is shown in FIG. 1, this printer includes a casing 1, an ASIC (application specific integrated circuit) 10, a thermal head 20, a thermistor 30, an ink ribbon 40, a motor driver 50, a feed motor (paper feed/discharge motor) 60, a mode motor 70, paper sensors 91 and 92, a tray sensor 93, a cartridge sensor 94, a marker sensor 95, and a display part 184 which (for example) a liquid crystal display or the like. The thermal printer 1 also includes a platen roller 80 (see FIG. 3), although this is omitted from FIG. 1 for the sake of simplicity.

Furthermore, as is shown in FIG. 2, the ASIC 10 includes a CPU (central processing unit) 110, a ROM (read only memory) 120, a RAM (random access memory) 130, a head controller 140, a motor controller 150, an A/D port 160, a USB (universal serial bus) interface (hereafter referred to as "USB/IF") 171, a memory card controller 172, an input part 173, and a video output part 174.

To describe the ASIC 10 in detail, as is shown in FIG. 1, the ASIC 10 controls the feed motor 60 and the mode motor 70 via the motor driver 50. In this case, in the ASIC 10, the motor controller 150 controls the motor driver 50 based on instructions from the CPU 110. Particularly, the control of the motor driver 50 by the motor controller 150 can be accomplished independently from and in parallel with other controls by the CPU 110, as is shown in FIG. 2.

Here, the feed motor 60 is a motor that is used for feeding/discharging or conveying of an image receiving paper 2 (FIG. 3), which is used as a printing paper in this embodiment, with respect to the thermal head 20.

The mode motor 70 is a motor that is used to control the orientation of the thermal head 20. More specifically, the mode motor 70 is used to switch between a head-up mode, during which the thermal head 20 is moved away from the image receiving paper 2 and the platen roller 80 to separate the thermal head 20 from the image receiving paper 2, and during which feeding and discharge of the paper are allowed (see the arrow indicating the head-up operation SP1 in FIG. 3); and a head-down mode, during which the thermal head 20 is caused to approach the image receiving paper 2 and the platen roller 80 so that the thermal head can be pressed against the image receiving paper 2 to perform the printing (see the arrow indicating the head-down operation SP3 in FIG. 3).

FIG. 3 schematically illustrates the head-up operation SP1 and the head-down operation SP3, in which the thermal head 20 pivots about a direction perpendicular to the paper plane of FIG. 3. However, it would also be possible, for example, to perform the head-up operation SP1 and the head-down operation SP3 in a construction in which the thermal head 20 linearly moves toward and away from the platen roller 80.

As is shown in FIG. 3, the thermal head 20 and the platen roller 80 are opposite each other. The thermal head 20 has a plurality of heating resistors or heating elements 21 on the side facing the platen roller 80. In the thermal head 20, the plurality of heating elements 21 are arranged in a line in a direction perpendicular to the paper plane of FIG. 3. Each of the heating elements 21 corresponds to a dot in the image to be printed. Moreover, the thermal head 20 has a driver (not shown in the figures) that provides a heat generating current.

The printing system of the thermal printer 1 will be described with reference to FIG. 3. The ink ribbon 40, as is shown in FIG. 3, has a base film 40*a*, and a dye ink layer 40*b* of yellow (Y), magenta (M), and cyan (C), which is laid on a base film 40*a*, such that color printing can be accomplished by superimposing the printing in each of the colors. Furthermore, the image receiving paper 2 has a substrate 2*a* and a receiving layer 2*b* laid on the surface of the substrate 2*a*.

In the sublimation thermal printer 1, the ink ribbon 40 and the image receiving paper 2 are set between the thermal head 20 and the platen roller 80 so that the dye ink layer 40*b* and the receiving layer 2*b* contact each other with the ink ribbon 40 being on the side of the thermal head 20. Then, the ink of the dye ink layer 40*b* is melted by the heat of the heating elements 21, and this ink is transferred to the receiving layer 2*b* of the image receiving paper 2, so that coloring and printing are accomplished. In this case, the transfer of the ink and the amount of ink transferred, i.e., the printing density or printing gradations, are controlled by the temperature of the abovementioned heating elements 21. The printing density increases as this temperature of the heating elements 21 increases.

In such printing system, the control of the temperature of the abovementioned heating elements 21 is basically accomplished by the ASIC 10 that controls, based on the printing density data for the dots corresponding to the heating elements 21, the time during which the power is to be supplied to each of the heating elements 21. More specifically, as is shown in FIG. 2, the head controller 140 receives instructions from the CPU 110, and controls the power transmission time to each of the heating elements 21 based on these instructions.

This control of the power transmission time by the head controller 140 can be performed independently from and in parallel with other controls of the CPU 110. The head controller 140 not only controls the power transmission during the printing, but also controls the power transmission for the preheating prior to the printing. Specifically, the head controller 140 controls the heat generation at the heating elements 21 of the thermal head 20 under the control of the control part 100. Furthermore, since the temperature control of the heating elements 21 can be accomplished by controlling the energy supply to these heating elements 21 in any form, another construction is also possible in which the printing energy is controlled by controlling the voltage applied to the heating elements 21 instead of the power transmission time.

Furthermore, as is shown in FIGS. 1 and 2, the thermistor 30 which is an example of the temperature detector detects the temperature of the thermal head 20 (hereafter also referred to as the "head temperature") is disposed in the thermal head 20. The signal from this thermistor 30 is sent to the CPU 110 via the A/D port 160 of the ASIC 10, and the head temperature is detected.

The paper sensors 91 and 92 monitor the conveyance of the image receiving paper 2, and the tray sensor 93 monitors the mounting of the paper tray (not shown in the figures). The cartridge sensor 94 monitors the mounting of a cartridge (not shown in the figures) in which the ink ribbon 40 is accommodated. The marker sensor 95 monitors a marker provided on the ink ribbon 40 for the purpose of positioning the ink ribbon 40. Additionally, although it is not shown in FIG. 1, the signals of the respective sensors 91 through 95 are processed by the ASIC 10.

Furthermore, as is shown in FIG. 2, the CPU 110 of the ASIC 10 can receives printing data and the like from the USB device 181 via the USB/IF 171. The CPU 110 of the ASIC 10 can also receive printing data and the like from the memory card 182 via the memory card controller 172. Furthermore, the CPU 110 can receive remote control signals from a remote controller 183 via the input part 173. Moreover, the CPU 110 displays various types of information on the display part 184 via the video output part 174.

The ROM 120 is accessible by the CPU 110. Various types of processing and the like (described above and described later) are performed according to programs (not shown in the figures) stored in the ROM 120. Furthermore, the RAM 130 is also accessible by the CPU 110. For example, the CPU 110 reads and writes various types of printing data and the like from and into the RAM 130. A flag 131 utilized in the monitoring of the head temperature described below is assigned to a portion of the RAM 130, and the CPU 110 can also access this flag 131. Furthermore, the CPU 110 also includes a counter or timer 111 as interrupt means for performing periodic interrupts that are utilized in the head temperature monitoring as described below.

The CPU 110, the ROM 120 and the RAM 130 are collectively referred to as the "control part 100." As described above, the head controller 140 controls the heat generation in the thermal head 20 based on the instructions from the control part 100. Furthermore, the feed motor 60 and the mode motor 70 are collectively referred to as the "mechanical element part 200" (see FIG. 1). As described above, the mechanical element part 200 is controlled by the motor controller 150 via the motor driver 50 based on the instructions from the control part 100. In other words, the mechanical element part 200 is controlled under the control of the control part 100.

Figure 4:
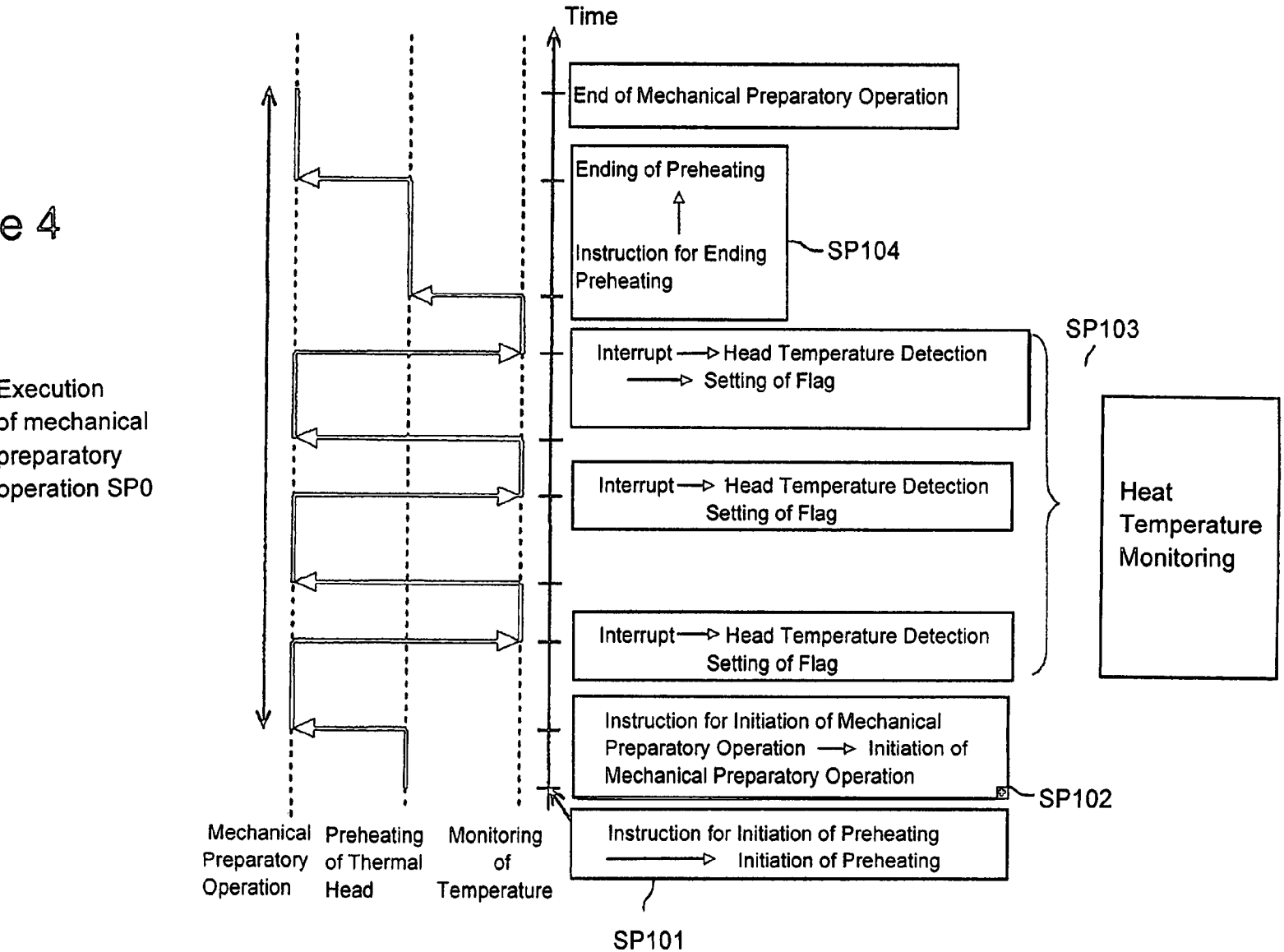
FIG. 4 is a schematic diagram used to illustrate the operating flow prior to printing in a thermal printer constituting one embodiment of the present invention.

FIG. 4 shows a schematic diagram that illustrates the operational flow of the thermal printer 1 prior to the printing. The operations prior to printing include a preheating operation in which the thermal head 20 is preheated by transmitting power to the heating elements 21 of the thermal head 20 (see FIG. 3), and a mechanical operation that physically sets the image receiving paper 2 (see FIG. 3) and the thermal head 20 ready for printing. These tow operations are graphically illustrated in FIG. 4. Furthermore, the preheating initiation instruction SP101 described below is issued by the control part 100 controlling the head controller 140, more specifically the CPU 110 controlling the head controller 140 according to the programs stored in the ROM 120 and with reference to the RAM 130.

First, in the thermal printer 1, the control part 100 instructs the head controller 140 to initiate the preheating of the thermal head 20. Accordingly, the power transmission to the thermal head 20 is started. As a result, the preheating of the thermal head 20 is initiated. (preheating initiation instruction SP101).

Then, after the initiation of the preheating, the control part 100 executes the mechanical preparatory operation SP0 to prepare the mechanical element part 200 for printing (mechanical preparatory operation execution instruction SP102). Here, FIG. 5 shows a diagram that illustrates the mechanical preparatory operation SP0.

Figure 5:
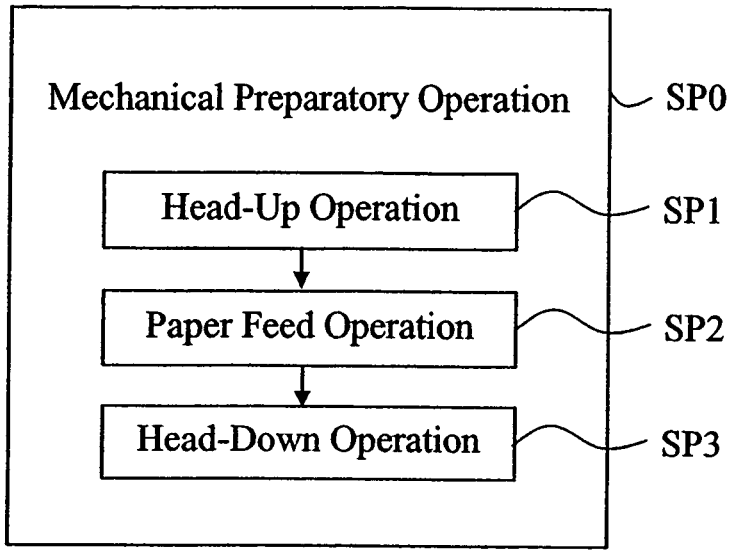
FIG. 5 is a diagram used to illustrate the mechanical preparatory operation in a thermal printer constituting one embodiment of the present invention.

As is shown in FIG. 5, the following plurality of operations are performed in a sequence as an example of the abovementioned mechanical preparatory operation SP0 to set the image receiving paper 2 (see FIG. 3) in a state that allows printing. More specifically, during the mechanical preparatory operation SP0, the mode motor 70 is driven by a switching instruction from the ASIC 10 so that the thermal head 20 is placed in a head-up position (head-up operation SP1, also shown in FIG. 3). Then, the feed motor 60 is driven by conveyance instruction from the ASIC 10 so that the image receiving paper 2 (FIG. 3) is supplied or fed to the printing initiation position, which is below the thermal head 20 (paper feed operation SP2). When the image receiving paper 2 is set in the printing initiation position, the mode motor 70 is driven by another switching instruction from the ASIC 10 so that the thermal head 20 is placed in a head-down position (head-down operation SP3, also shown in FIG. 3). These operations SP1 through SP3 are collectively referred to as the mechanical preparatory operation SP0.

In this case, since the thermal printer 1 has the motor controller 150 that controls the mechanical element port 200 based on the instructions from the control part 100, the control part 100 can execute the mechanical preparatory operation SP0 by, for example, successively sending instructions for initiation and execution of the head-up operation SP1, the paper feed operation SP2, and the head-down operation SP3 to the motor controller 150.

Furthermore, as shown in FIG. 4, the control part 100 detects the head temperature via the thermistor 30 at each periodic interrupt performed by the timer 111 (see FIG. 2) while the mechanical preparatory operation SP0 is being executed, and thereby monitors whether or not the head temperature has reached a preheating-ending temperature (head temperature monitoring instructions SP103). When the preheating-ending temperature has been reached, the flag 131 (see FIG. 2) is set. FIG. 4 shows, for example, a case in which the preheating-ending temperature has been reached at the third temperature detection. In particular, in the thermal printer 1, the periodic interrupts are set with a period such as 1 to 2 milliseconds, which is shorter than the conveyance time of one sheet of image receiving paper 2.

Then, when the head temperature has reached the preheating end temperature, the control part 100 ends the preheating of the thermal head 20 (preheating ending instruction SP104). More specifically, the control part 100 can ascertain whether or not the preheating-ending temperature has been reached from the state of the flag 131, in other words, whether or not the flag 131 has been set. Where the flag 131 has been set, i.e., that the preheating-ending temperature has been reached, the control part 100 instructs the head controller 140 to end the preheating. In the case of this embodiment, the control part 100 instructs the head controller 140 to stop transmission of the power to the thermal head 20.

In this manner, the mechanical preparatory operation SP0 ends. This completes the operations prior to the printing.

In such a thermal printer 1, the mechanical preparatory operation SP0 (head-up operation SP1, the paper feed operation SP2, and the head-down operation SP3) is initiated following the initiation of the preheating of the thermal head 20, and the head temperature monitoring operation SP103 monitors the head temperature during the execution of the mechanical preparatory operation SP0, and thereby monitors the end timing of the preheating. In other words, the preheating of the thermal head 20 and the mechanical preparatory operation SP0 are performed at the same time in parallel.

By performing the preheating and the mechanical preparatory operation SP0 in parallel in this manner, the overall processing time prior to the printing can be shortened as compared to a case (see FIG. 7) in which the preheating of the thermal head and the mechanical preparatory operation are performed serially. From the user's viewpoint, this processing time prior to the printing is waiting time. Accordingly, by performing the preheating and the mechanical preparatory operation SP0 in parallel, it is easier for the user to use the printer.

Figure 7:
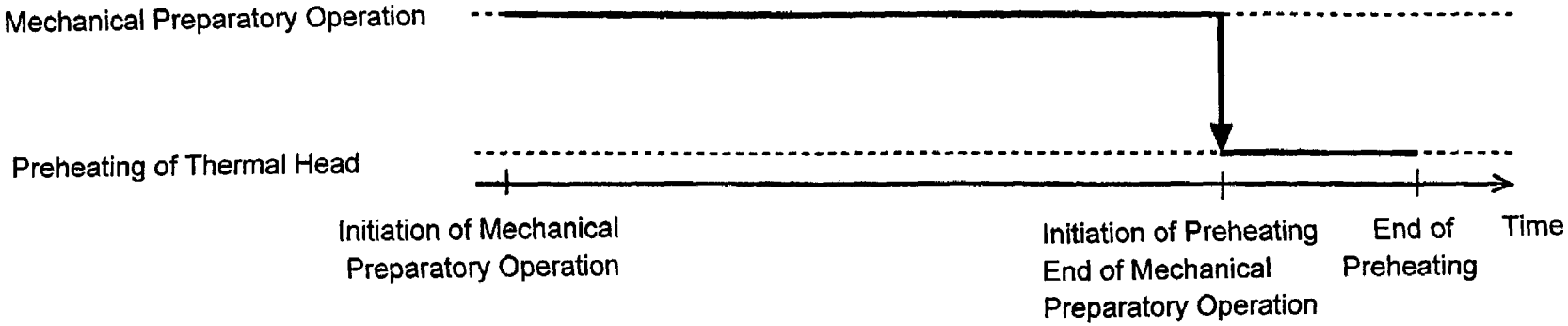
Figure 7 PRIOR ART
FIG. 7 is a schematic diagram used to illustrate the operating flow of a thermal printer used for comparison.

Furthermore, by performing the preheating and the mechanical preparatory operation SP0 in parallel in this manner, the preheating time can be lengthened. Since the preheating is performed while the mechanism preparatory operation SP0 is in progress, the preheating can be preformed for a longer period of time while still shortening the overall processing time. Accordingly, as compared to the case in which the preheating is performed quickly after the mechanism preparatory operation in order to shorten the time as shown in FIG. 7, the amount of current to be supplied can be reduced, so that the useful life of the thermal head 20 can be extended.

In particular, in the above described embodiment, the temperature detection during the head temperature monitoring operation SP103 is performed at each periodic interrupt operation performed by the timer 111 during the mechanical preparatory operation SP0. Furthermore, the period between two interrupt operations can be set at a value shorter than the conveyance time of one sheet of the image receiving paper 2. Accordingly, it is possible to perform finer temperature control as compared to the case in which the head temperature is not detected until one sheet of the image receiving paper is conveyed in the normal direction. As a result, the preheating end timing can be obtained more precisely. Accordingly, occurrence of an excessive accumulation of heat due to the preheating end temperature being exceeded can be reduced, so that the useful life of the thermal head can be prolonged.

Furthermore, in the above description, the mechanical preparatory operation includes the head-up operation SP1, the paper feed operation SP2, and the head-down operation SP3. However, various types of operations are conceivable as the mechanical preparatory operation SP0 that is performed prior to the printing. In other words, by performing the preheating of the thermal head and the mechanical preparatory operation (which generally includes a time-consuming mechanical operation) in parallel, it is possible to shorten of the above-mentioned printing preparation time and while allowing the useful life of the thermal head to be lengthened. For example, since the paper feed operation SP2 requires a longer operating time than the head-up operation SP1 or the head-down operation SP3, it would also be possible to perform only the paper feed operation SP2 of the mechanical preparatory operation SP0 in parallel with the preheating operation.

Figure 6:
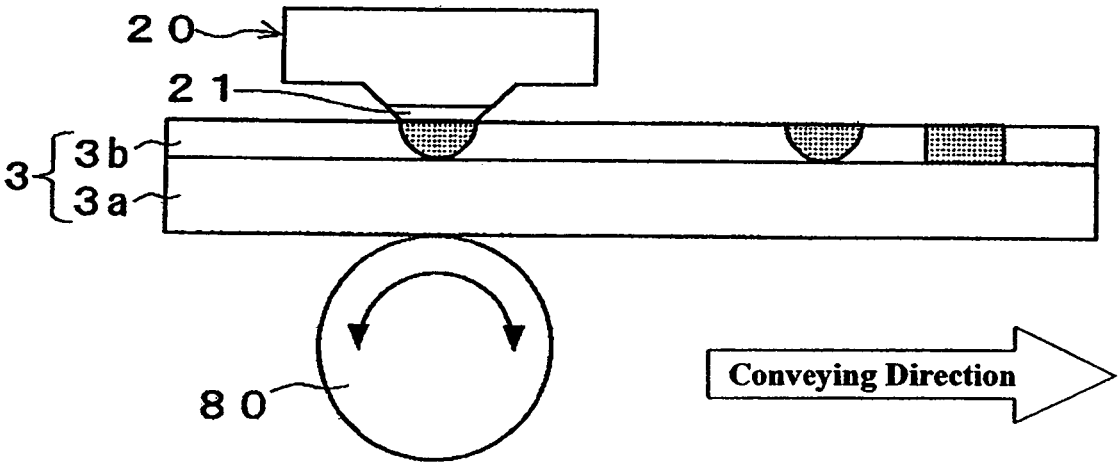
FIG. 6 is a schematic diagram used to illustrate a thermal printer constituting one embodiment of the present invention.

Furthermore, the color printing is described as an exampled in the above-described embodiment. However, the thermal printer 1 can also be applied to black and white printing. Furthermore, as shown in FIG. 6, the thermal printer 1 may also perform printing using as the recording paper a heat-sensitive paper 3 in which a substrate 3*a* and heat-sensitive layer 3*b* are laminated, instead of the ink ribbon 40 (see FIG. 3) and the image receiving paper 2.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2005-007439. The entire disclosure of Japanese Patent Application No. 2005-007439 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A thermal printer adapted to perform printing on a paper, the thermal printer comprising:

a casing;

a control part;

a thermal head pivotally supported to the casing and operatively connected to the control part such that the thermal head is heated upon a heating instruction from the control part and the heating is ended upon a heating-ending instruction from the control part;

a temperature detector operatively connected to the control part such that the temperature detector detects a temperature of the thermal head upon a temperature detection instruction from the control part; and a feed motor adapted to convey the paper, the feed motor being operatively connected to the control part such that the feed motor is driven upon a conveyance instruction from the control part and that the conveyance is ended upon a conveyance-ending instruction from the control part;

the control part being configured to issue, prior to printing, the heating instruction and the conveyance instruction such that the heating of the thermal head and the conveyance of the paper are performed in parallel, the control part being configured to issue the temperature detection instruction as an interrupt every predetermined period of time after the heating instruction is issued, the control part being configured to issue the heating-ending instruction when the temperature of the thermal head detected by the temperature detector reaches a predetermined preheat-ending temperature, the control part being configured to issue the conveyance instruction such that the feed motor starts the conveyance of the paper before the temperature of the thermal head detected by the temperature detector reaches the predetermined preheat-ending temperature.

2. The thermal printer according to claim 1, wherein the control part is configured to issue the temperature detection instruction as an interrupt every 1-2 milliseconds.

3. A thermal printer adapted to perform printing on a paper, the thermal printer comprising:

a casing;

a control part;

a thermal head pivotally supported to the casing and operatively connected to the control part such that the thermal head is heated upon a heating instruction from the control part and the heating is ended upon a heating-ending instruction from the control part;

a temperature detector operatively connected to the control part such that the temperature detector detects a temperature of the thermal head upon a temperature detection instruction from the control part;

a feed motor adapted to convey the paper, the feed motor being operatively connected to the control part such that the feed motor is driven upon a conveyance instruction from the control part and that the conveyance is ended upon a conveyance-ending instruction from the control part;

a platen roller rotatably supported to the casing; and a mode motor operatively connected to the control part and the thermal head so as to, upon a switching instruction from the control part, switch between a head-up mode in which the thermal head is pivoted away from the platen roller, thereby allowing the conveyance of the paper, and a head-down mode in which the thermal head is pivoted toward the platen roller, the control part being configured to issue, prior to printing, the heating instruction and the conveyance instruction such that the heating of the thermal head and the conveyance of the paper are performed in parallel, the control part being configured to issue the temperature detection instruction as an interrupt every predetermined period of time after the heating instruction is issued, the control part being configured to issue the heating-ending instruction when the temperature of the thermal head detected by the temperature detector reaches a predetermined preheat-ending temperature, the control part being configured to issue the switching instruction and the heating instruction, such that the heating of the thermal head is performed in parallel with the pivoting of the thermal head away from the platen roller.

4. The thermal printer according to claim 1, wherein the control part is an ASIC.

5. A thermal printer adapted to perform printing on a paper, the thermal printer comprising:

a casing;

a platen roller rotatably supported to the casing;

a control part which is an ASIC;

a thermal head pivotally supported to the casing and operatively connected to the control part such that the thermal head is heated upon a heating instruction from the control part and the heating is ended upon a heating-ending instruction from the control part;

a temperature detector operatively connected to the control part such that the temperature detector detects a temperature of the thermal head upon a temperature detection instruction from the control part; and a feed motor adapted to convey the paper, the feed motor being operatively connected to the control part such that the feed motor is driven upon a conveyance instruction from the control part and that the conveyance is ended upon a conveyance-ending instruction from the control part;

a mode motor operatively connected to the control part and the thermal head so as to, upon a switching instruction from the control part, switch between a head-up mode in which the thermal head is pivoted away from the platen roller, thereby allowing the conveyance of the paper, and a head-down mode in which the thermal head is pivoted toward the platen roller, the control part being configured to issue, prior to printing, the switching instruction, the heating instruction, and the conveyance instruction such that the heating of the thermal head is performed in parallel with the pivoting of the thermal head away from the platen roller and the conveyance of the paper, the control part being configured to issue the temperature detection instruction as an interrupt every 1-2 milliseconds after the heating instruction is issued, the control part being configured to issue the heating-ending instruction when the temperature of the thermal head detected by the temperature detector reaches a predetermined preheat-ending temperature.

6. A method of preheating a thermal head of a thermal printer before the thermal printer performs printing on a paper, comprising starting heating of the thermal head;

starting conveyance of the paper such that the paper is conveyed while the thermal head is heated;

detecting a temperature of the thermal head as an interrupt every predetermined period of time while the thermal head is heated; and ending the heating of the thermal head when the temperature of the thermal head reaches a predetermined preheating-ending temperatures, the starting the conveyance of the paper including starting the conveyance of the paper before the temperature of the thermal head reaches the predetermined preheating-ending temperature.

7. A method of preheating a thermal head of a thermal printer before the thermal printer performs printing on a paper, comprising:

starting heating of the thermal head;

starting conveyance of the paper such that the paper is conveyed while the thermal head is heated;

detecting a temperature of the thermal head as an interrupt every predetermined period of time while the thermal head is heated;

ending the heating of the thermal head when the temperature of the thermal head reaches a predetermined preheating-ending temperature;

pivoting the thermal head away from a platen roller before the conveyance of the paper while the thermal head is heated; and pivoting the thermal head toward the platen roller after the conveyance of the paper.

* * * * *